United States Patent [19]

Bajek et al.

[11] Patent Number: 4,895,334

[45] Date of Patent: Jan. 23, 1990

[54] WALL-MOUNTABLE CADDY

[75] Inventors: Thomas R. Bajek, LaGrange Park; John P. Chap, Lemont, both of Ill.

[73] Assignee: Selfix, Inc., Chicago, Ill.

[21] Appl. No.: 297,597

[22] Filed: Jan. 17, 1989

[51] Int. Cl.[4] ..... A47H 1/16

[52] U.S. Cl. ..... 248/302; 248/309.1

[58] Field of Search ..... 248/309.1, 314, 302, 248/213.2, 223.3, 324, 175, 176, 218.1, 303, 304, 117.1; 211/85, 88, 89, 106, 181

[56] References Cited

U.S. PATENT DOCUMENTS

| | | | |
|---|---|---|---|
| 2,603,438 | 7/1952 | Adams | 248/302 X |
| 3,212,742 | 10/1965 | Pavoni | 248/302 X |
| 3,313,504 | 4/1967 | Stoltze | 248/302 X |
| 3,606,022 | 9/1971 | Beesley, Jr. | 211/181 X |
| 3,789,996 | 2/1974 | Stroh | 248/302 X |

OTHER PUBLICATIONS

Photocopy A1: Copy of catalogue page of product "Q-11374 Vac-caddy".

Photograph A2: Photograph of front view of Vac--caddy.

Photograph A3: Photograph of side view of Vac--Caddy.

Photocopy B1: Copy of product card showing "Grayline Vacuum Accessory Kaddy".

Photograph B2: Photograph of rear view of Grayline Vacuum Accessory Kaddy.

Photograph B3: Photograph of side view of Grayline Vacuum Accessory Kaddy.

Photograph C1: Photograph of rear view of another metal vacuum accessory basket.

Photograph C2: Photograph of side view of another metal vacuum accessory basket.

Photocopy D: Copy of a product card of a dish drainer basket.

*Primary Examiner*—Ramon O. Ramirez

*Attorney, Agent, or Firm*—Dressler, Goldsmith, Shore, Sutker & Milnamow, Ltd.

[57] ABSTRACT

A wall-mountable organizer or caddy comprises an article or tool-retaining portion including an open sided basket portion formed in part with a plurality of upright article holders, and a depending hanger portion from which one or more articles, such as a hose, can be hung. The front and sides of the basket portion are defined by plural U-shaped basket frame members lying generally in a horizontal plane when the organizer is mounted on a vertical support, such as a wall. The basket includes a shelf formed in part by a plurality of L-shaped article holding members. Each of the holders includes a vertically extending upright or front leg, which is attached or otherwise mounted in fixed relation to the front leg of at least one of the basket frame members, and a rearwardly extending cantilevered bottom leg portion forming part of the shelf. The upright legs of some of the holders are not attached to the front legs of the basket frame members, but are spaced forwardly of the front legs of the other basket frame members. This permits the holders to receive and retain articles having hollow tubular portions placed over the ends thereof.

Each end of the caddy is unobstructed so as to permit a long object, such as a wand, to be transversely inserted therethrough while being supported on the shelf of the basket portion.

10 Claims, 2 Drawing Sheets

WALL-MOUNTABLE CADDY

TECHNICAL FIELD

This invention relates generally to wall-mountable organizers, and more particularly to organizers for household tools, such as tools and accessories used with household vacuum cleaners.

BACKGROUND OF THE INVENTION

Typically, vacuum cleaners, especially those designed for household use, include a hose attachment and an assortment of associated tools and accessories, such as tubular wands and various nozzles and brushes with tubular necks. Because of their singular shapes, such tools create storage problems.

Wall-mountable, wire frame racks and storage devices are extremely popular with space conscious household consumers. These handy products can be mounted or hung on supports, e.g., walls and doors, in a variety of locations around the house, such as in kitchens, bathrooms, garages, utility rooms, basements and closets. Typically, units of this type are made from wire which is coated with vinyl or plastic, or which is plated, to provide a durable corrosion-free surface that protects both the items being stored and the support to which the organizer is mounted from being damaged, e.g., from mars and scratches. The vinyl or plastic coating may come in a variety of colors to enhance appearance and complement the needs of decorative conscious consumers. Such devices are usually designed to be quickly and easily fastened to, or mounted on, an appropriate support surface, such as a wall or door.

Although there are support-mountable storage devices marketed for storage of such vacuum cleaner accessories, e.g., tubular and irregular shaped tools and their associated wands and hoses, or similarly shaped articles, such storage devices do not adequately accommodate such articles. Such storage devices typically include a basket or container portion into which the various tools or articles are dumped and a hanger or hook portion from which a hose can be hung. The problem with such configurations is that the tools often do not fit within the container portion, or hang in a way that allows them to be knocked out of or otherwise fall from the storage device. In addition, such configurations do not accept wands and other elongated articles which are normally longer than the storage device is wide. These items are often just laid on top of the device, where they can easily fall off, since they are not properly retained in place.

Thus, it would be desirable to provide a support mountable storage device or organizer for such household tools or articles which would adequately store and retain such articles, would be able to accommodate tubular and irregularly shaped articles, and would at the same time be nestable for efficient storage and shipping of the organizers prior to use and installation.

SUMMARY OF THE INVENTION

This invention provides an improved, organizer or caddy for household tools, particularly, but not exclusively, those tools and accessories used with vacuum cleaners, particularly those designed for household use.

The wall-mountable organizer or caddy incorporating the present invention comprises an article or tool-retaining portion including an open sided basket portion formed in part with a plurality of upright article holders, and a depending hanger portion from which one or more articles, such as a hose, can be hung.

The front and sides of the basket portion are defined by plural U-shaped basket frame members lying generally in a horizontal plane when the organizer is mounted on a vertical support, such as a wall. The ends of the basket wall members are attached to the side legs of a U-shaped outer frame member located at the back of the organizer and which is used to mount the organizer on a support and which lies generally in a vertical plane when the organizer is mounted on a vertical support, such as a wall. The bottom leg of the outer frame is formed with a forwardly extending hanger portion disposed below the basket portion for retaining articles, such as a hose, which may be hung therefrom.

The basket includes a bottom or shelf formed in part by a plurality of L-shaped article holding members. Each of the holders includes a vertically extending upright or front leg, which is attached or otherwise mounted in fixed relation to the front leg of at least one of the basket frame members, and a rearwardly extending cantilevered bottom leg portion forming part of the shelf. The upright legs of some of the holders are not attached to the front legs of the basket frame members, but are spaced forwardly of the front legs of the other basket frame members. This permits the holders to receive and retain articles such as vacuum cleaner tools, e.g. nozzles, having hollow tubular portions placed over the ends thereof and slid down with the upright leg inserted inside of the hollow articles.

Each end of the caddy is unobstructed so as to permit a long object, such as a wand, to be transversely inserted therethrough while being supported on the shelf of the basket portion.

Thus, a hose can be draped over the hanger, a pair of tubular wands or other elongated article can be inserted through the open sides of the basket portion, and nozzles, brushes, and other articles having tubular necks can be placed over the free end of each holder so those tools can be stored in a compact, organized arrangement.

Numerous other advantages and features of the present invention will become readily apparent from the following detailed description of the invention and the embodiments thereof, from the claims and from the accompanying drawings in which the details of the invention are fully and completely disclosed as part of the specification.

DETAILED DESCRIPTION OF PREFERRED EMBODIMENT

Figure 1:
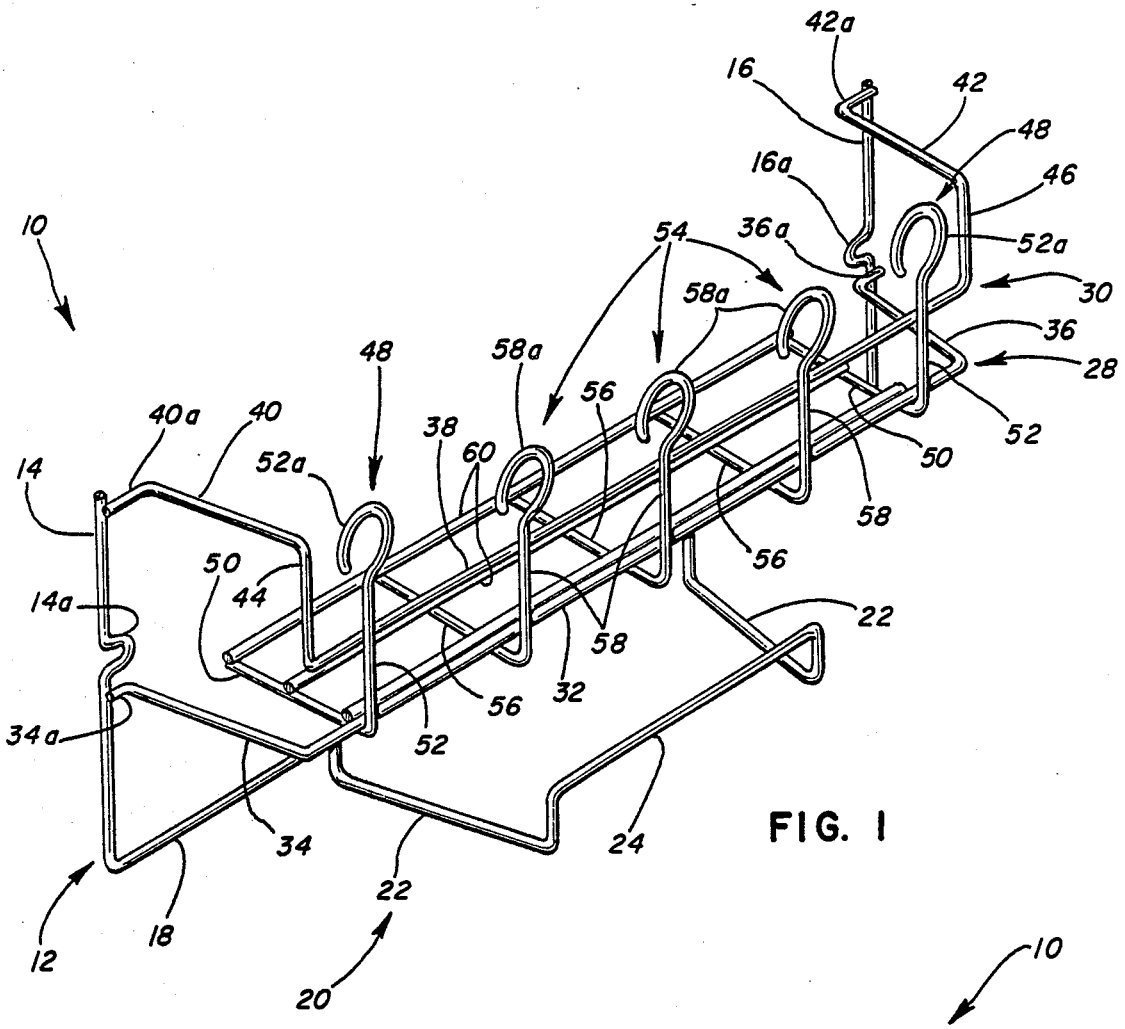
FIG. 1 is a perspective view of a wall-mountable caddy incorporating the present invention.
Figure 2:
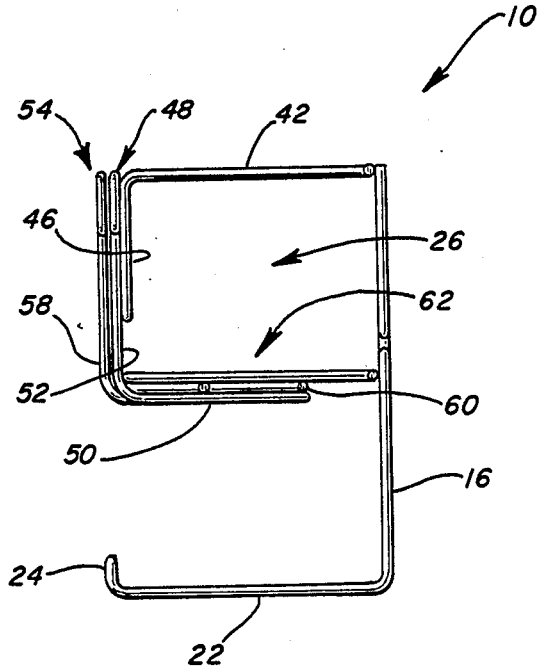
FIG. 2 is an end view thereof.
Figure 3:
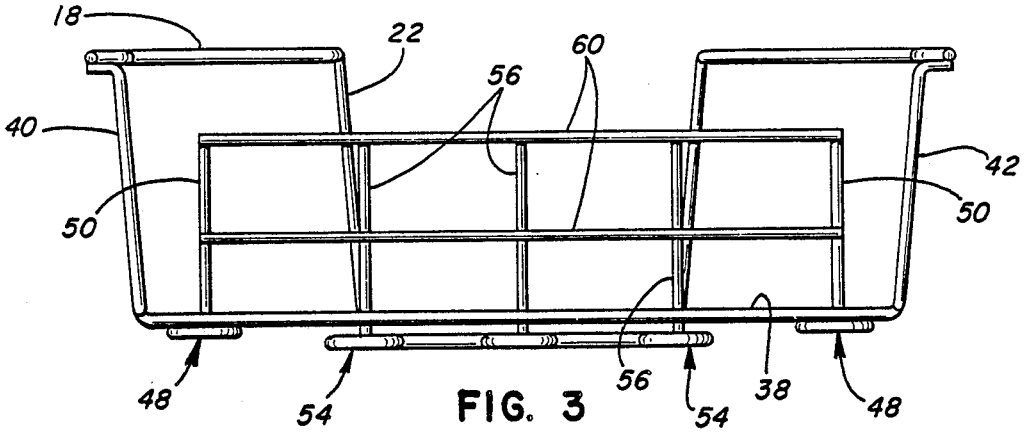
FIG. 3 is a top plan view thereof.
Figure 4:
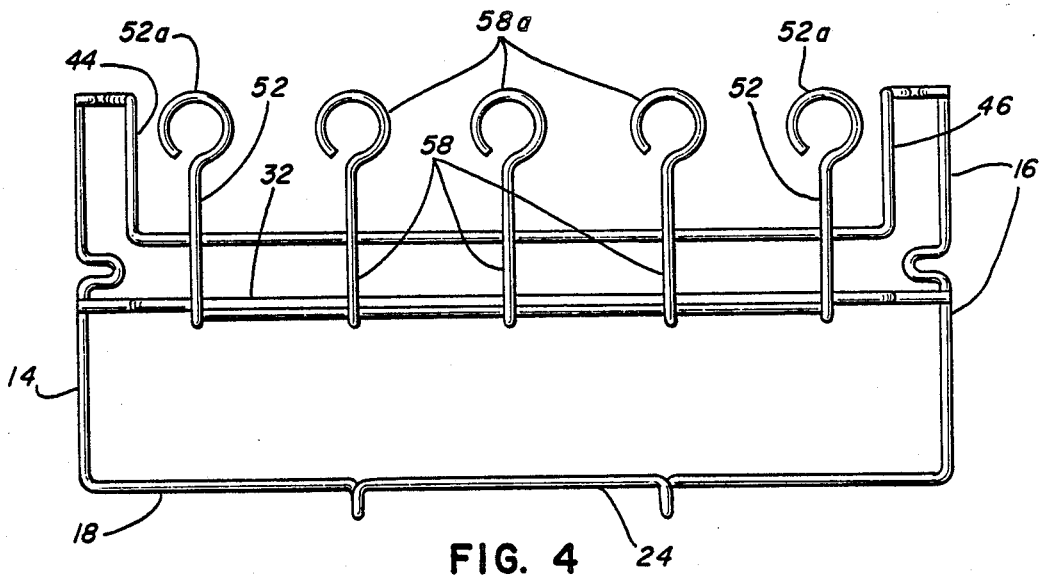
FIG. 4 is a front elevational view thereof.
Figure 5:
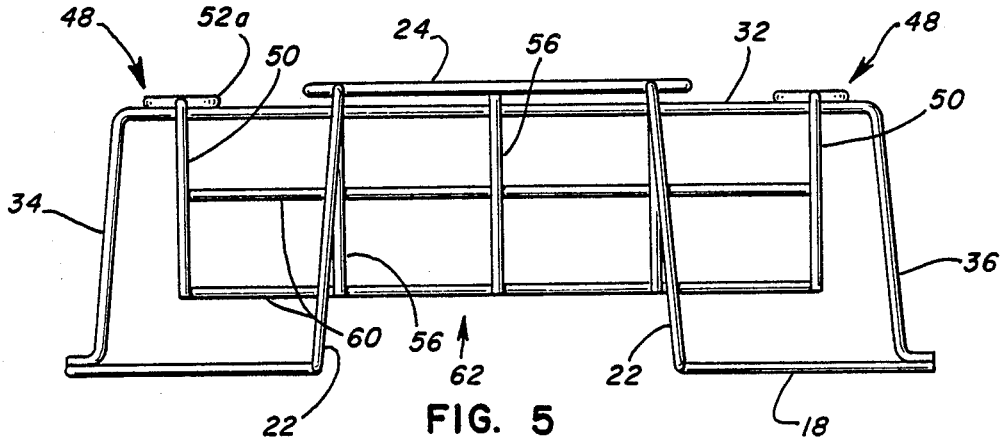
FIG. 5 is a bottom plan view thereof.

While this invention is susceptible of embodiment in many different forms, there is shown in the drawings and will be described herein in detail a specific embodiment thereof with the understanding that the present disclosure is to be considered as an exemplification of the principles of the invention and is not intended to limit the invention to the specific embodiment illustrated.

Directional terms used herein, including "transverse", "upper", "lower", "upright", "vertical", "front", and "back", and terms based thereon are for convenience of reference and refer to a preferred orientation of such a caddy, as and when mounted on a wall.

There is shown in the drawings a wall-mountable caddy or organizer 10 incorporating the present invention for various tools, such as those used as accessories for a vacuum cleaner, constitutes a preferred embodiment of this invention. The organizer 10 is suitable for mounting on a support, such as a wall or door, and is shown as constructed from appropriately shaped and interconnected plastic coated metal wire members. The plastic coating may comprise vinyl or a like material which is suitably durable and corrosion resistant, and which is typically available in a wide variety of colors for enhancing the aesthetic appeal of the organizer. The organizer 10 may be fabricated in accordance with known methods, typically comprising suitable interconnection of its various members by welding or other similar method, followed by application of a plastic coating to the entire arrangement.

The caddy 10 includes a U-shaped outer frame 12 disposed generally at the rear of the caddy 10 and lying generally in a vertical plane. The outer frame 12 is formed with left and right side mounting legs 14, 16, each of which includes shaped fastener retaining portion, such as open eyelets **14*a*, 16*a*, respectively, through each of which a suitable fastener may be passed to mount the caddy 10 to a support, such as a wall W. The outer frame 12 also includes a bottom transverse leg 18 interconnecting the side legs 14, 16**.

The transverse bottom leg 18 is formed with a forwardly extending, U-shaped hanger portion 20, which includes side legs 22 and a front leg 24 formed as a raised lip to retain articles thereon, such as a hose hung therefrom.

The caddy 10 includes a basket or article-retaining portion 26 formed in part by lower and upper U-shaped basket frame members 28, 30. The lower frame member 28 includes a front leg 32 and left and right rearwardly extending side legs 34, 36, formed with outwardly flared ends **34*a*, 36*a* attached to the side legs 14, 16, respectively, of outer frame 12. The upper basket frame member 30 includes a front leg 38 and upwardly offset left and right rearwardly extending side legs 40, 42 formed with outwardly flared ends 40*a*, 42*a* attached to the side legs 14, 16, respectively, of outer frame 12 at a point spaced above the side legs 34, 36 of lower basket frame member. Thus, the sides of the basket portion are open to allow passage of articles therethrough. The forward ends of upper left and right side legs 40, 42 are connected to the opposite ends of upper front leg 38 by vertical intermediate legs 44, 46**, respectively.

The front legs 32, 38 of basket frame members 28, 30 extend transversely, in forwardly spaced relation to the wall W, and in vertically spaced relation to each other when the caddy 10 is mounted on the wall W.

A pair of outer generally L-shaped holders 48 are disposed adjacent the ends of the front legs 32, 38 of the basket frame members 28, 30. The holders 48 include rearwardly extending cantilevered bottom leg portions 50 and front vertically extending upright leg portions 52 which terminate at their upper ends in loops **52*a*. The upright front leg portions 52 of outer holders 48 are attached to the front legs 32, 38 of the basket frame members 28, 30**.

A plurality of inner generally L-shaped holders 54 are disposed intermediate the outer holders 48. The holders 54 include rearwardly extending cantilevered bottom leg portions 56 and front vertically extending upright leg portions 58 which terminate at their upper ends in loops **58*a*. The upright front leg portions 58 of inner holders 54 are not attached to the front legs 32, 38 of the basket frame members 28, 30, but are spaced forwardly thereof. Minor sections of the cantilevered bottom legs 56 of the holders 54 extend forwardly of the basket frames 28, 30 to serve as lower rests for tubular objects placed over the free ends 58*a* of the upright legs 58 of inner holders 54**.

A pair of transverse bottom members 60 are connected to the bottom legs 50, 56 of the holders 48, 54 to define a bottom shelf for the basket portion 26. The bottom members also serve to connect the inner holders 54 to the caddy since the upright legs 58 of the inner holders 54 are not connected to the basket frame members 28,30.

Each end of the caddy 10 is unobstructed, as shown, so as to permit a long object to be lengthwise inserted through one such end of the caddy 10, between the left side legs 34, 40 and right side legs 36, 42 of basket frame members 28, 30.

Thus, a caddy incorporating the present invention is capable of storing various tools associated with vacuum cleaners in a compact, organized arrangement. For examples, a hose can be draped over the hanger, and tubular wands can be inserted through the open sides of the basket to rest on the shelf, and nozzles, brushes and other tools having tubular necks can be placed over each of the holders.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the appended claims.

What is claimed is:

1. A wall-mountable caddy comprising:

main frame means mountable to a wall;

a basket portion supported by said main frame portion comprised of upper and lower basket frame members connected to said main frame means a plurality of article holder means, a selected number of said holder means being attached to at least one of said basket frame members, said selected number being less than all of said holder means, and said unconnected holder means being spaced from said basket frame members to define an article receiving space therebetween; and means connecting said holder portions to each other and thereby connecting said unconnected holder means to said caddy.

2. A wall-mountable caddy as claimed in claim 1 wherein:

said upper frame member is generally U-shaped and includes a front leg portion and two side leg portions, said side leg portions being attached to said main frame means and extending forwardly therefrom, said front leg portion extending between said side leg portions and being forwardly spaced from the wall.

3. A wall-mountable caddy as claimed in claim 2 wherein:

said lower frame member, is generally U-shaped and includes a front leg portion and two side leg portions upwardly of set from said front leg portion, said side leg portions being attached to said main frame means and extending forwardly therefrom, said front leg portion extending between said side leg portions and being forwardly spaced from the wall.

4. A wall-mountable caddy as claimed in claim 1 wherein:

said holder connecting means comprise at least one transverse member.

5. A wall-mountable caddy as claimed in claim 1 wherein:

said main frame means includes hanger means disposed below the basket means.

6. A wall-mountable caddy as claimed in claim 1 wherein:

each of said holder means includes a cantilevered portion forming part of a shelf.

7. A wall-mountable caddy as claimed in claim 6 wherein:

at least some of said holder means includes an upright portion spaced forwardly relative to said basket upper frame member.

8. A wall-mountable caddy as claimed in claim 4 wherein:

at least some of said holder means upright portions are spaced forwardly relative to said basket upper and lower frame members.

9. A wall-mountable caddy as claimed in claim 1 wherein:

the sides of said basket means are open to allow passage therethrough of articles disposed in said basket.

10. A wall-mountable caddy as claimed in claim 2 wherein:

said holder members and said connecting means define a shelf member disposed below said upper and lower frames members and extending rearwardly from the front legs thereof toward.

* * * * *